US005586866A

United States Patent [19]

Wettstein

[11] Patent Number: 5,586,866

[45] Date of Patent: Dec. 24, 1996

[54] BAFFLE-COOLED WALL PART

[75] Inventor: Hans Wettstein, Fislisbach, Switzerland

[73] Assignee: ABB Management AG, Baden, Switzerland

[21] Appl. No.: 510,307

[22] Filed: Aug. 2, 1995

[30] Foreign Application Priority Data

Aug. 26, 1994 [DE] Germany ..... 44 30 302.5

[51] Int. Cl.[6] ..... F01D 5/18

[52] U.S. Cl. ..... 416/96 A; 416/97 R

[58] Field of Search ..... 416/96 A, 97 R

[56] References Cited

U.S. PATENT DOCUMENTS

| | | | |
|---|---|---|---|
| 3,606,572 | 9/1971 | Schwedland | 416/96 A |
| 3,781,129 | 12/1973 | Aspinwall | 416/96 A |
| 3,864,199 | 2/1975 | Meginnis | 416/97 A |
| 4,042,162 | 8/1977 | Meginnis et al. | 416/96 A |
| 4,056,332 | 11/1977 | Meloni | 416/96 A |
| 4,118,146 | 10/1978 | Dierberger | 416/97 A |
| 4,168,348 | 9/1979 | Bhangu et al. | 416/97 A |
| 4,269,032 | 5/1981 | Meginnis et al. | 416/97 A |
| 4,768,700 | 9/1988 | Chen | 416/97 A |
| 5,352,091 | 10/1994 | Sylvestro | 416/96 A |
| 5,370,499 | 12/1994 | Lee | 416/97 A |

FOREIGN PATENT DOCUMENTS

| | | |
|---|---|---|
| 2127454 | 12/1971 | Germany . |
| 2313047 | 9/1974 | Germany . |
| 2526277C2 | 1/1984 | Germany . |

*Primary Examiner*—Edward K. Look
*Assistant Examiner*—Mark Sgantzos
*Attorney, Agent, or Firm*—Burns, Doane, Swecker & Mathis

[57] ABSTRACT

A baffle cooling arrangement for wall parts includes a wall having a wall part to be cooled, a carrier having an inner and an outer surface, the inner surface of the carrier being arranged at a distance from the wall part, and multiple baffle tubes are provided. The baffle tubes each have an inlet end and an outlet end. The inlet ends of the baffle tubes are arranged over an area on the outer surface of the carrier and the outlet ends of the baffle tubes are directed toward the wall part, the tubes extending into a space between the inner surface of the carrier and the wall part.

15 Claims, 1 Drawing Sheet

BAFFLE-COOLED WALL PART

BACKGROUND OF THE INVENTION

Field of the Invention

The invention relates to a baffle cooling for wall parts, for example of flow-round hot turbomachine components, such as gas turbine blades or combustion chamber walls.

Of the convective cooling methods, the highest heat transmission coefficients can be achieved by baffle cooling. Thus, where gas turbines are concerned, as a rule cooling-air jets are generated via a perforated plate and are directed against the wall to be cooled. Arrangements considered to be optimum are those in which the distance between the perforated plate and the wall is in the ratio of 1 to 2 the hole diameter.

Discussion of Background

Cooling methods of this type are known, for example from DE-C2-2,526,277. In the blade shown there, actual baffle chambers are provided at the blade tip and on the suction side adjacent thereto. In the hollow blade interior, they are limited by inserts which correspond to the blade shape and which are provided with a plurality of cooling-air passage orifices. A major problem in arrangements of this type is the flow transverse to the jet direction which deflects the jets and can render them ineffective before they strike the wall to be cooled. Such transverse flows are unavoidable when not merely a line, that is to say only a hole row, but an area is to be cooled. To remedy this, in said blade, the cooling air, after impact, is diverted into the hot flow as film air by means of suitably arranged hole patterns in the wall to be cooled. A disadvantage of this solution is that the cooling air must have a higher pressure than the hot flow into which it is diverted through the cooling-air outflow orifices. This relative overpressure can often be generated only by an additional blower. Furthermore, utilizations of cooling air which are closed or which are connected in series are possible only to a limited extent, because the film air is lost as cooling air.

SUMMARY OF THE INVENTION

The object on which the invention is based is, therefore, to provide a baffle cooling for wall parts, in which the flow-off of the cooling medium transversely to the jet direction does not impair the jet effect.

This is achieved, according to the invention, by means of a multiplicity of baffle tubes which are arranged with their inlet over an area on a plane or curved carrier and which are directed with their outlet towards the wall part to be cooled, the carrier being arranged at a distance from the wall part.

The baffle jets deflected after the impact can now flow off unimpeded in the free interspace between the baffle-tube outlet and the carrier located at a distance corresponding to the length of the baffle tubes.

Although it is already known from U.S. Pat. No. 2,973,937 to cause a cooling medium to strike against a wall via baffle tubes, called nozzles there, this is nevertheless the single-row arrangement of nozzles which was already mentioned initially and in which the diversion of the cooling jets after the impact presents no problem. Moreover, the element to be cooled is the vertical wall of a rotating turbine wheel, in the case of which a radially flowing boundary layer complicating the heat transmission builds up. The reason for the baffle cooling employed there is to be seen inter alia in the breaking up of this boundary layer.

The advantages of the present invention are to be seen inter alia in that, now, an intensive cooling with the smallest possible quantity of cooling medium and with a low pressure drop is achieved. This in turn affords the possibility of implementing the classic baffle film arrangements with an enlarged film area. The film hole rows can then, in the case of flow-round components, be arranged at the locations having a lower external pressure.

It is particularly expedient if, in the case of gas turbine blades to be cooled, the carrier together with the baffle tubes is arranged as an insert in the hollow interior of the blade, and if a plurality of such inserts are provided. The same cooling medium can thereby flow through the inserts in series. Closed baffle-cooling systems with an increased baffle-jet velocity can also be implemented. Furthermore, there is the possibility of executing the flow-off of the cooling medium at locations of low pressure, for example at the trailing edge of gas turbine blades.

If the cooling medium circulates in a closed circuit, higher cooling pressures can be brought about, with the result that the heat transmission coefficient can be increased. This is the case inter alia when steam is used as the cooling medium, this becoming possible in combination installations. An advantage of this is that the higher pressure of the cooling medium is then generated beneficially in energy terms in the feed pump instead of in the compressor.

Finally, in contrast to the initially described cooling-air jets which are generated via a perforated plate, the invention affords the advantage of the free design of the ratio of the jet spacing to the jet diameter. This can extend perfectly well over a range from 0.1 to 4.

BRIEF DESCRIPTION OF THE DRAWINGS

A more complete appreciation of the invention and many of the attendant advantages thereof will be readily obtained as the same becomes better understood by reference to the following detailed description, when considered in connection with the accompartying drawings, wherein several exemplary embodiments of the invention are represented in simplified form and in which.

Only the elements essential for understanding the invention are shown. In the various Figures, the functionally identical elements are provided with the same reference symbols. The direction of flow of the cooling medium is designated by arrows.

DESCRIPTION OF THE PREFERRED EMBODIMENTS

Figure 1:
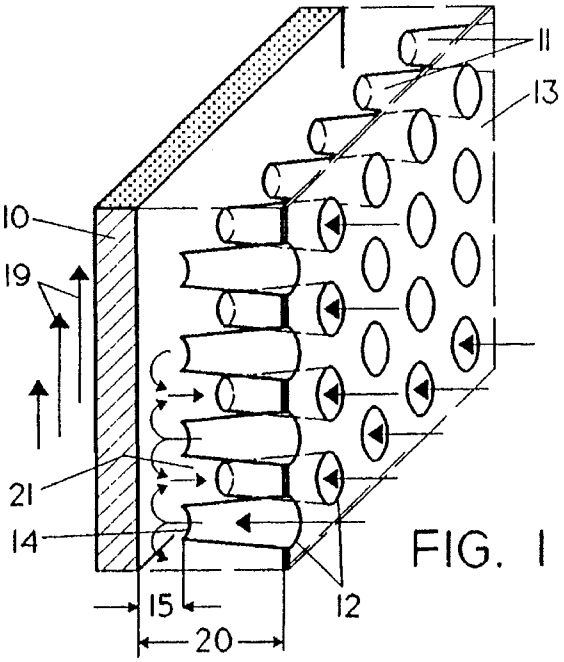
FIG. 1 shows a perspective view of a baffle-cooled element.

Referring now to the drawings, wherein like reference numerals designate identical or corresponding parts throughout the several views, in FIG. 1 the wall part to be cooled, for example, by means of cooling air is designated by 10. This is a plane wall, around which a hot medium, designated by the arrows 19, flows on the outside. The carrier 13 located on the cooling-air side is also correspondingly made plane. In the instance shown, it is fastened to the wall at a constant distance 20 by suitable means not shown.

The carrier is provided over its area with a plurality of baffle tubes 11, here equidistant and arranged in rows. Their inlet 12 is flush with the carrier surface. The baffle tubes have a conical inner channel with a continuous narrowing in the direction of flow. The narrowest cross section of the baffle tubes is therefore located at the outlet 14. The baffle tubes are directed with their outlet 14 perpendicularly towards the wall part to be cooled. The outlet is located at the baffle distance 15 from the wall. In the example, the ratio of this baffle distance to the narrowest diameter of the baffle tubes is approximately 1. It is evident that the cooling air deflected after the impact can flow off into the free interspaces 21 between the baffle tubes, without thereby disturbing adjacent baffle jets. With a perpendicular orientation of the baffle tubes, the light-free dimension of interspace is determined by the length of these.

Figure 2:
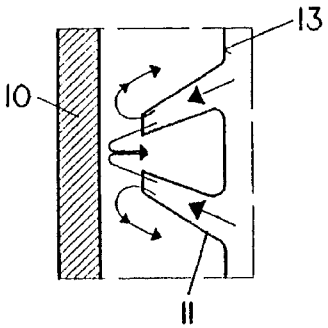

According to FIG. 2, in one design version, a plurality of adjacent baffle tubes 11 extend obliquely and are directed onto a limited surface area of the wall part 10. The cooling effect can thereby be concentrated onto particularly exposed zones.

Figure 3:
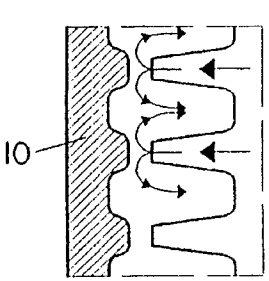

In FIG. 3, the baffle surface of the wall part 10 to be cooled is designed as a relief, i.e., to have relieved or recessed areas and projecting areas the jets striking the projecting pumps. Consequently, the non-homogeneous heat transmission in the baffle jets can be compensated, and a homogeneous temperature distribution on the hot side of the wall part is achieved.

Figure 4:
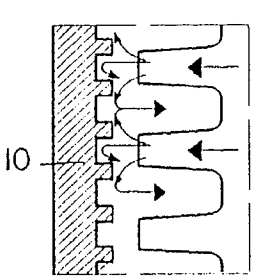

FIG. 4 shows a wall part 10 ribbed on the cooling-air side. An equalization of the cooling effect on the ribbed wall is achieved by means of an increased jet length and jet thickness in relation to the thickness of the wall to be cooled.

Figure 5:
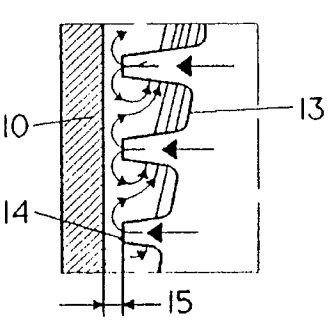
FIGS. 2 to 5 show, in cutout form, four different versions of a baffle-cooled element.

FIG. 5 shows an example with a variable baffle tube length increasing in a specific direction. For a constant distance 15 between the respective baffle outlet 14 and the wall part 10, the carrier 13 extends obliquely relative to the wall part. In the case of a flow-off of the cooling air in a specific direction, a constant transverse flow velocity between the baffle tubes is sought after by means of this version.

Figure 6:
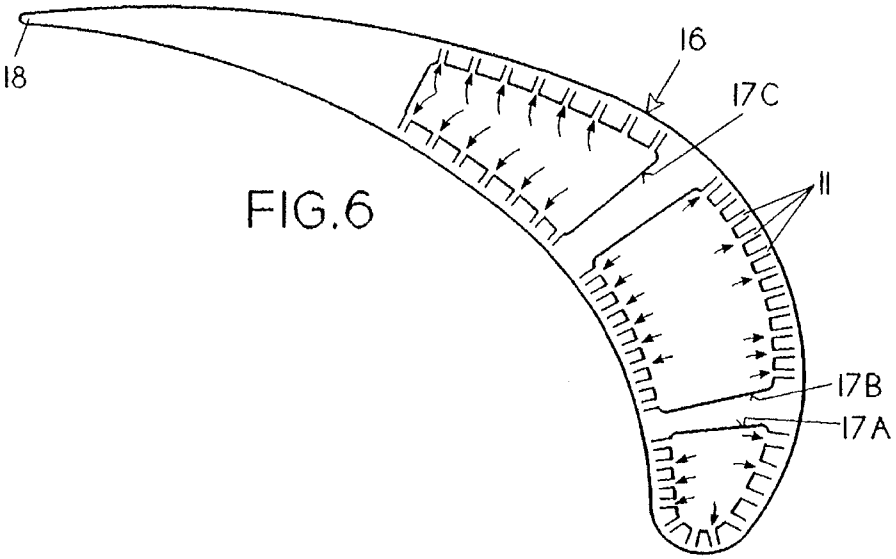
FIG. 6 shows a baffle-cooled gas turbine blade.

In FIG. 6, the wall part to be cooled is a gas turbine blade 16. The carriers together with the baffle tubes are designed as more or less tubular inserts 17A, 17B and 17C and are arranged in the hollow interior of the blade. These inserts together with the baffle tubes 11 can be cast or deep-drawn. They can also be designed as a pressure-bearing structure for internal pressures which can amount to double the pressure prevailing in the actual baffle zone.

Where a guide blade is concerned, the inflow of the cooling medium into the inserts 17A–C takes place, as a rule, from the blade root towards the blade tip. The baffle tubes 11 are staggered at the necessary distance relative to one another over the blade height and blade circumference and are directed with their outlet towards the inner wall of the hollow blade. The cooling medium can flow through the inserts 17A–C individually or in series.

The gaseous or vaporous cooling medium can be circulated in the plurality of inserts in a closed circuit, that is to say, after the cooling activity has been completed, it is drawn off again via the blade root. However, the cooling medium flowing off from the cooled wall parts can also emerge from the blade into the flow channel. This takes place preferably at that location of the blade at which the lowest external pressure prevails. As a rule, the cooling medium will thus be caused to emerge at the trailing edge 18 of the blade.

Of course, the invention is not restricted to the examples shown and described. It goes without saying that, depending on requirements, the baffle tube arrangement, the number and division of the baffle tubes as well as their length and shape, tapered or cylindrical, can be optimized in each particular case. Nor does the invention place any limits on the choice of the cooling medium, its pressure and its further use after the cooling activity.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by Letters patent of the United States is:

1. A baffle cooling arrangement for wall parts, comprising;

a wall having a wall part to be cooled;

a carrier having an inner and an outer surface, the inner surface of the carrier being arranged at a distance from the wall part; and a plurality of baffle tubes, the baffle tubes each having an inlet end and an outlet end, the inlet ends of the baffle tubes being arranged over an area on the outer surface of the carrier and the outlet ends of the baffle tubes being directed toward the wall part, the tubes extending into a space between the inner surface of the carrier and the wall part.

2. The baffle cooling arrangement as claimed in claim 1, wherein the baffle tubes have a conical inner channel, a narrowest cross section of the conical inner channel of each baffle tube being disposed proximate the outlet end of the baffle tube.

3. The baffle cooling arrangement as claimed in claim 1, wherein a ratio of a distance of the outlet ends of the baffle tubes to the wall part to a narrowest part of the baffle tube is between 0.1 and 4.

4. The baffle cooling arrangement as claimed in claim 1, wherein a plurality of adjacent baffle tubes extend obliquely relative to one another.

5. The baffle cooling arrangement as claimed in claim 1, wherein the wall part includes relieved portions and projecting portions.

6. The baffle cooling arrangement as claimed in claim 1, wherein a distance between the outlet ends of the baffle tubes and the wall part is constant, and the inner and outer surfaces of the carrier extend obliquely relative to the wall part.

7. The baffle cooling arrangement as claimed in claim 1, wherein the carrier and the baffle tubes are cast.

8. The baffle cooling arrangement as claimed in claim 1, wherein the carrier and the baffle tubes are deep-drawn.

9. The baffle cooling arrangement as claimed in claim 1, wherein the wall part is part of a gas turbine blade having a hollow interior, and wherein the carrier and the baffle tubes are an insert arranged in the hollow interior of the blade.

10. The baffle cooling arrangement as claimed in claim 9, wherein a plurality of inserts are arranged in the hollow interior of the blade.

11. The baffle cooling arrangement as claimed in claim 10, wherein a cooling medium flows through the plurality of inserts in series.

12. The baffle cooling arrangement as claimed in claim 11, wherein the cooling medium circulates in the plurality of inserts in a closed circuit.

13. The baffle cooling arrangement as claimed in claim 9, wherein the cooling medium, after cooling the wall part, flows off from the cooled wall parts and is discharged from a trailing edge of the blade.

14. The baffle cooling arrangement as set forth in claim 1, wherein the outer surface of the carrier is curved.

15. The baffle cooling arrangement as set forth in claim 1, wherein the outer surface of the carrier is flat.

* * * * *